United States Patent [19]

Thomasset

[11] 4,033,396

[45] July 5, 1977

[54] OSCILLATING SUSPENSION FOR STRIPS OF PLASTIC MATERIAL

[75] Inventor: André Alphonse Thomasset, Caluire, France

[73] Assignee: Planet-Wattohm, Paris, France

[22] Filed: Aug. 16, 1976

[21] Appl. No.: 714,491

[52] U.S. Cl. ..... 160/332; 160/184; 24/201 A; 24/204

[51] Int. Cl.[2] ..... A47H 1/00

[58] Field of Search ..... 160/332, 330, 184; 24/201 A, 204, 226 F; 211/45, 113, 126; 248/307, 317; 312/183, 184; 402/2, 8, 9, 38, 501

[56] References Cited

UNITED STATES PATENTS

| | | | |
|---|---|---|---|
| 536,940 | 4/1895 | Schulze | 24/201 A |
| 1,462,803 | 7/1923 | Deserty | 248/307 |
| 1,525,694 | 2/1925 | Sage et al. | 24/201 A |

FOREIGN PATENTS OR APPLICATIONS

| | | | |
|---|---|---|---|
| 255,879 | 7/1964 | Australia | 160/332 |
| 1,508,336 | 11/1967 | France | 160/184 |

*Primary Examiner*—Peter M. Caun
*Attorney, Agent, or Firm*—Brisebois & Kruger

[57] ABSTRACT

Suspension for curtain of plastic strips comprises a beam having a U-shaped section and longitudinally spaced transverse slots. T-shaped hook members are attached to the tops of the plastic strips and extend through the slots so that the cross-bars of the T-shaped hooks rest on the inside of the beam on opposite sides of the slot.

8 Claims, 5 Drawing Figures

OSCILLATING SUSPENSION FOR STRIPS OF PLASTIC MATERIAL

SUMMARY OF THE INVENTION

This invention relates to a method of suspending strips of flexible transparent plastic material, such as those which are used in a known manner as a curtain to cover certain doorways in commercial buildings.

When used for this purpose the strips are suspended from their upper ends and overlap or cover each other in order to constitute a flexible screen while permitting individuals and vehicles to pass easily therethrough.

In the method now most commonly in use, these strips are suspended from their attachment point, in a rigid manner transversely to their plane. This may present a disadvantage. In those cases in which the vehicles or loads passing through the doorway covered in this manner have a height approximating the height of the doorway, the attachment points of the strips are subjected to an abnormal pull, which may cause tearing of the plastic material at the attachment point.

In an attempt to overcome this disadvantage it has already been suggested that the strips of plastic material be suspended by pivotal means. In such a case each strip is attached to a metallic hook in the form of a hinge turning about a cylindrical axis at the upper part of the doorway. During the passage of a vehicle or a load having a height approximating the height of the doorway the hinge turns about the cylindrical axis, thus reducing the stresses developed in the upper part of the strip. However, this arrangement has, in practice, an important disadvantage because the pivotal movement is produced by the rotation of a sheet on an axis while the contacting surfaces have not been machined or treated and without using roller-type or other bearings, so that the friction between the metallic parts rapidly makes it difficult and even impossible due to seizing. The suspensions of curtains of this type are, in effect, generally subjected to inclement weather and good operation of the hinges is rapidly compromised by the presence of rust and the absence of grease.

The object of the invention is to overcome the disadvantages of these embodiments and to create a device for suspending strips of plastic material which are to form the curtains of doorways, which is of simple and robust construction, with functions reliably, and which does not require any particular maintenance.

The invention takes the form of a suspension of the type in question adapted for strips of plastic material constituting curtains for doorways, characterised by the fact that it comprises a hollow metallic beam having a generally U-shaped section, attached along the top of the opening, and slots provided in the lower part of this hollow beam transversely to its longitudinal axis, and suspending means attached to the upper end of each strip, said suspending means being in the form of hooks, each hook having at least one part passing freely through one of the slots in the beam and a retaining head having a width greater than that of the associated slot and resting on the inner surface of the hollow beam to suspend the strip or part of the strip associated therewith.

Thus, each suspension member rigidly connected to a strip of plastic material passes freely through a slot formed in the hollow beam and rests at its head on the inner surface of said beam near the bottom thereof so as to insure the suspension of the strip. By reason of this method of suspension, if a force acts on the strip, and especially near its point of suspension, in a principal direction perpendicular to the longitudinal axis of the beam, the head of the suspension member oscillates on the inner surface of the beam like the knife of a balance beam. The associated part of said suspension member passes through the slot in the beam and oscillates in the slot, transversely to the longitudinal axis of said beam. The stresses which may be exerted on the attachment points of the strips in the known embodiment are thus eliminated by simple means which require no maintenance and function reliably.

Preferably the slots in the beam are oriented transversely to the length of the beam and occupy not only the lower part thereof, but also at least part of the arms of the U-shaped member, so that in case of high strain, exerted for example by the passage of a vehicle having a height very close to that of the free height of the doorway, the suspension member, and especially its head slides on the inner face of the hollow beam, while the part of this suspension member engaged transversely of the slot moves therein so that the assembly may assume a position permitting an almost horizontal position for the strip of plastic material, without excessive strain on the attachment point.

In a preferred embodiment of the invention, each slot in the hollow beam has at least one larger part of the section of which corresponds substantially to the shape of the head of the suspension member, so as to permit easy engagement of said head in said opening. In accordance with a desirable embodiment, the suspension member is T-shaped with the vertical branch of the T passing freely through the larger part of the slot in the beam while the transverse branch rests on the inner surface of the beam. Slot segments at right angles to the transverse slots of said beam may be provided and have a section corresponding the substantially to the width of the transverse branch of the T of the suspension member. These slot segments may extend from one side or both sides of the main slots in the beam.

In accordance with another feature, the space between or "pitch" of the slots in the beam is clearly less than the width of the strips of plastic material, and each strip carries a suspension member provided with a certain number of hooks, the pitch of which is equal to that of the slots in the beam. Thus it is possible to vary at will the relative points of suspension of the strips and consequently adjust their overlap in any desired manner.

The beam may be attached to the upper edge of the doorway in any desired manner.

The following description, given with reference to the accompanying drawings, purely by way of illustration and example, will make it easier to understand the invention:

Figure 1:
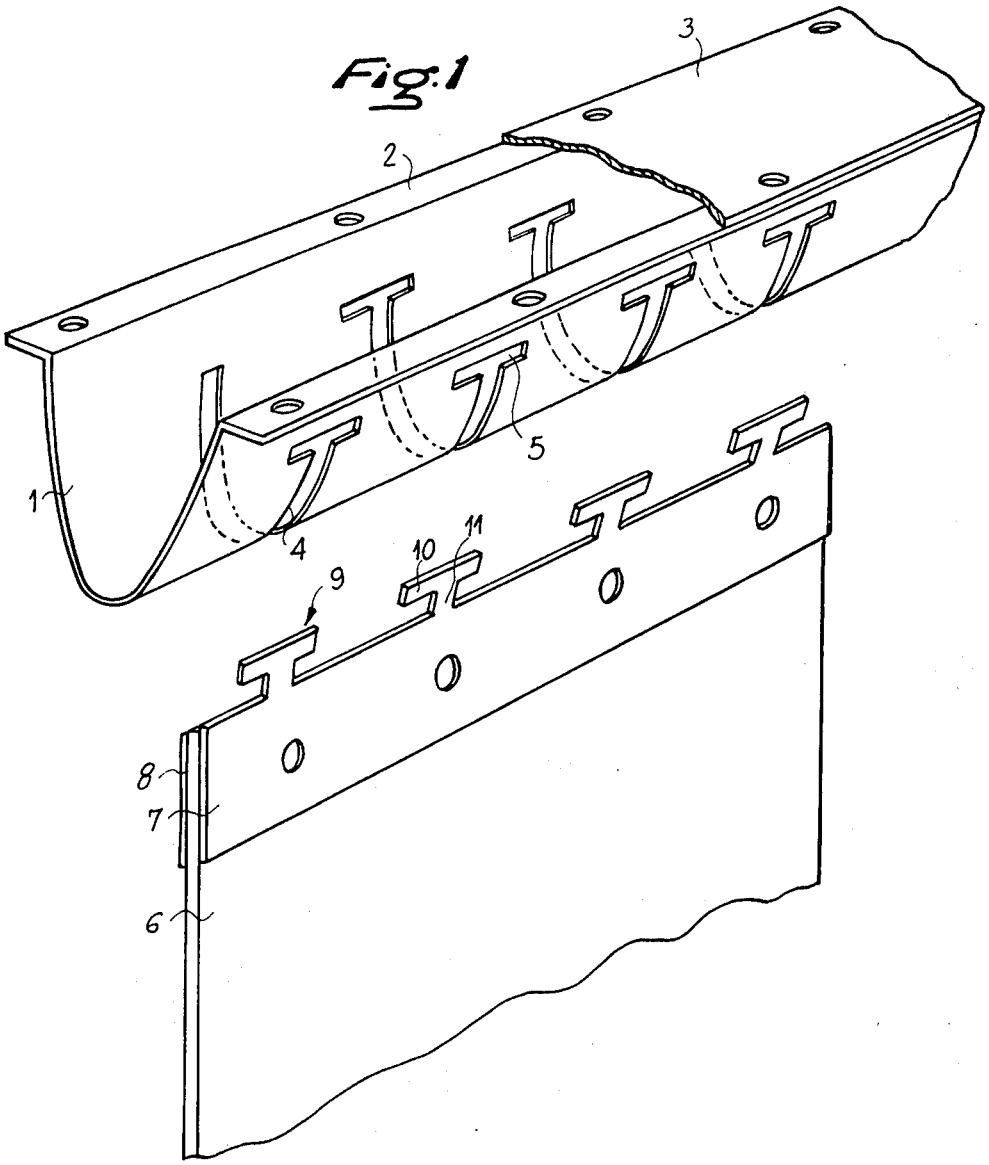
FIG. 1 is an exploded perspective view showing the supporting beam for the strips of plastic material according to the invention and the upper part of a strip.

Referring now to FIG. 1, it will be seen that this shows a supporting beam 1 having a generally U-shaped section, with convergent arms. The two arms of the beam have at their upper ends outwardly projecting flanges 2 so as to permit attachment of the beam to a horizontal surface of the building above the doorway to be covered.

The length of this beam corresponds to the width of the doorway. If desired, this beam may be reinforced by a sheet metal plate 3 connecting the two arms of the U so as to form a box beam.

The slots 4 which are regularly distributed along the length of the beam 1 extend transversely to that beam and upwardly into the arms thereof. In FIG. 1 each slot 4 terminates at at least one end in a T-shaped portion comprising a slot segment 5 extending parallel to the axis of the beam on oppsite sides of the transverse slot 4.

The upper end of each strip 6 carries a suspension plate 7 made of metal or any other sufficiently strong material rigidly attached to that strip by any suitable means such as bolts, rivets, crimping, etc. The length of the plate 7 is at least equal to the width of the strip 6. If desired a lamination 8 may be used to reinforce the attachment.

The upper part of the suspension plate 7 carries suspension members or hooks 9 having a T-shape and separated from each other by the same distance as the slots 4 in the beam 1. Each hook 9 has, as indicated, a T-shape with the transverse branch or head 10, which has a width substantially equal, to the length of the segments 5 of the slots 4 is connected to the suspension plate 7 by a part 11, itself having a width permitting it to slide freely in the slot 4.

The way in which the strips of plastic material 6 are mounted on the beam 1 fixed to the upper part of the doorway is easily comprehended from an examination of the drawing. To bring about this mounting the heads 10 of the hooks 9 are brought opposite the segments 5 of the slots 4 so that the suspension members of the plate and the beam may be freely interfitted as in the case of a mortise and tenon joint. The transverse branch or head 10 of each hook 9 then penetrates into the beam 1 and the part 11 of the hooks slides in the part 4 of the slots, with the weight of the strip then resting on the lower edge of the head of the hooks which overlie the inner surface of the beam, so that the assembly comes into a position in which the hooks rest in the lower part of the U of the beam. Thus the strips are suspended from the beam by the hooks.

Figure 3:
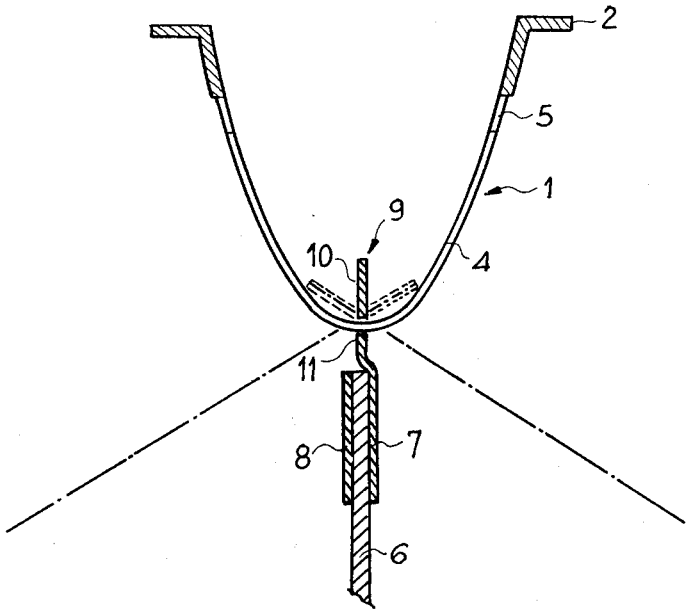
FIGS. 3 and 4 are transverse sectional views taken through a suspension member according to the invention.
Figure 4:
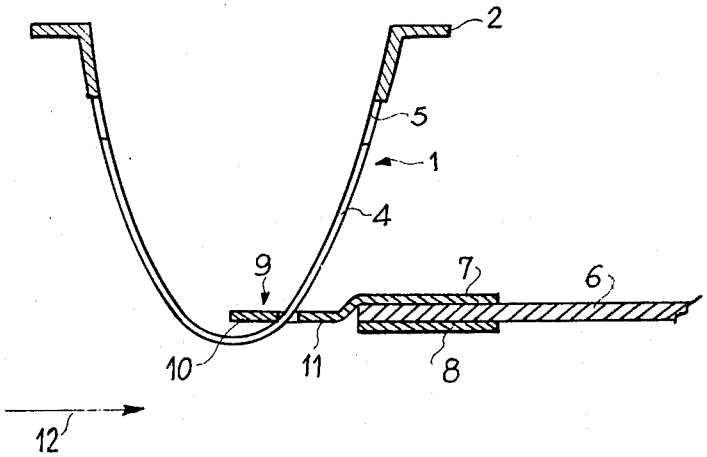

In this suspended position, if a vehicle, for example, passes through the doorway, it produces an oscillating movement of the assembly constituted by each strip and its suspension plate with its hooks relative to the beam in the manner schematically indicated on FIG. 3, with the head of each hook acting like the knife of a balance beam so as to permit this oscillating movement, in principle without friction. It has been found that the attachment points of the strips to the beam are not subjected to any effective stress. The curved shape of the beam also makes it possible for each hook to rest in the most favorable position for oscillation of each plastic strip on opposite sides of its equilibrium position, the part 11 of the hooks 9 fitting loosely in the slots 4. When a vehicle having a height nearly equal to that of the door, passes through, that is to say, if the pressure on the strips is produced, for example only a few centimeters beneath the beam, the oscillation of the hooks on the inner surface of this beam is followed by a slight sliding of the hooks inside the beam so that the strip-hook assembly may assume, if necessary, a position which is horizontal in principle, as schematically indicated on FIG. 4 (in which the pressure exerted is indicated by the arrow 12), without damage to the attaching assembly.

Since the spacing between the slots 4 and 5 of the beam is equal to the spacing between the hooks 9 of the suspension plate 7 it is possible to cause strips 6 to overlap each other at will by regulating the relative positions of the strips along the suspending beam.

Figure 2:
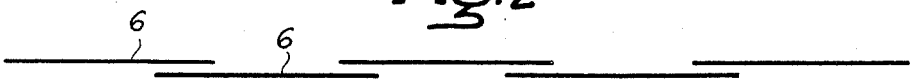
FIG. 2 is a schematic view showing the arrangement of the strips with respect to each other along the supporting beam.

FIG. 2 shows schematically one method of producing overlap.

In fact, if each plate or suspension strip has a width of 400 millimeters for example, and comprises 4 hooks, the two end hooks being positioned 50 millimeters from the ends of the plate, the hooks are spaced by a 100 millimeters from each other and if a spacing equal to 100 millimeters is provided between the slots of the beam, it is possible to obtain, in independence on the method of engaging the hooks in the various slots in the beam either (a) on overlap, (b) an overlap of 100 millimeters, (c) an overlap of 200 millimeters, (d) a complete overlap of 400 millimeters, with the relative distributions shown on FIG. 2.

The above mentioned arrangement thus makes it possible, in addition to providing a rapid and easy mounting of the strips on the supporting beam, to modify the overlap if the current of air requires it. Moreover, the strips may be easily removed to uncover the passage, for example if ventilation makes this necessary. They may also be regrouped one against the other on each side of the door so as to permit easy storage of the strips in a convenient location.

Figure 5:
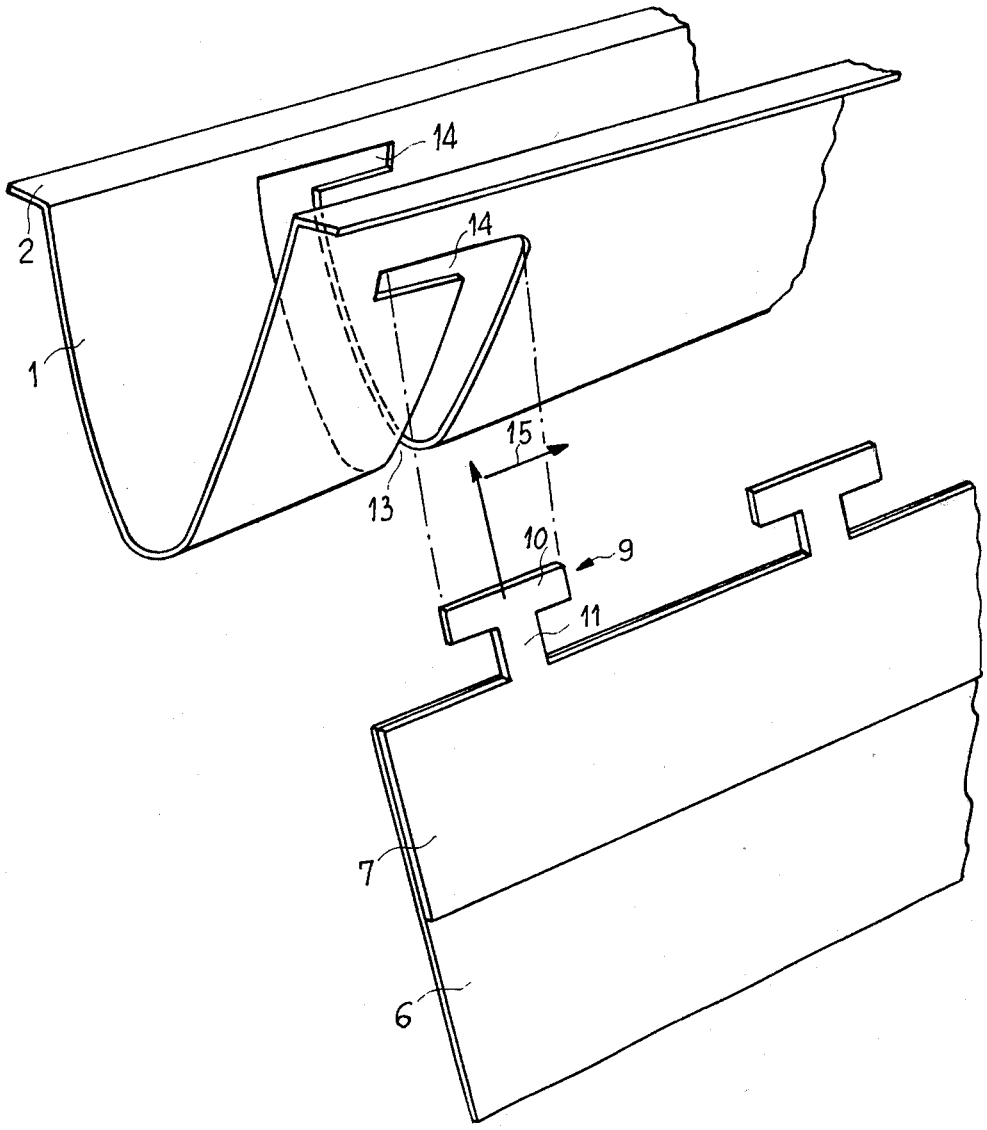
FIG. 5 is a perspective view of the supporting beam and a strip, showing another embodiment of the slots therein.

FIG. 5 shows another embodiment of the device according to the invention. On this Figure reference numeral 1 still indicates the supporting beam, provided with its arms 2, and reference numeral 6 indicates a strip of plastic material, to the upper edge of which is attached a suspension plate 7 provided with hooks 9 having heads 10 and connecting arm 11. In accordance with this embodiment the beam has openings in the form of transverse slots 13 with a width sufficient to permit the free passage of the part 11 of the hooks 9. In this case, near each end of each slot 13, there is a slot segment 14 at right angles to the slot 13 having a width sufficient to permit the passage of the head 10 of the hooks 9, these segments being oriented in opposite directions. In order to mount the strips the heads 10 of the hooks are engaged through the segments 14. Then when these heads are inside the beam, the strips 6 are longitudinally translated in the direction of the beam as indicted by the arrow 15 until the edge of the part 11 of the hooks 9 abuts against the straight edge of the slot 13. Downward displcement of the strip then causes the parts 11 of the hooks 9 to penetrate into the slots 13 so that each strip is properly positioned longitudinally of the beam. An arrangement of this type avoids any untimely disengagement of the hoods with respect to the slots of the beam even if the strip is subjected to a very high swinging movement.

The invention also relates to curtains or analogous assemblies adapted to cover doorways or other openings, especially in commercial building, comprising strips of plastic material suspended by means of a suspension device of the type described.

The embodiments described may, of course, be modified as to detail without thereby departing from the basic principles of the invention. It will be appreciated that, in particular, the beam may, by means known in themselves, be attached at its end to a vertical part of the building, if so desired.

What is claimed is:

1. Device for suspending strips of plastic material adapted to constitute curtains for doorways which comprises a hollow beam having a generally U-shaped section adapted to be attached to the upper part of the doorway, oscillation slots formed in the lower part of the hollow beam transversely to its longitudinal axis, and suspension means fixed to the upper ends of said strips, said suspension means comprising hooks, each of which has a portion which passes freely through one of the slots of the beam and a retaining head having a width greater than that of said slot and bearing on the inner surface of the hollow beam so as to at least partially support a strip associated therewith.

2. Device as claimed in claim 1 in which the slots in the beam ae oriented transversely to the length of the beam, are in the lower part of the beam and extend over at least part of the arms of the beam.

3. Device as claimed in claim 1 in which each suspension member has a T-shaped portion, a vertical arm of which passes freely through a slot in the beam, and a transverse branch which rests on the inner surface of said beam.

4. Device as claimed in claim 1 in which the distance between the openings in the beam is less than the width of the strips of plastic material and each strip carries a suspension member equipped with a plurality of hooks the distance between which is equal to that between the openings in the beam.

5. Curtain adapted to close a doorway which comprises strips of plastic material suspended by means of a suspension device according to claim 1.

6. Device as claimed in claim 1 in which each slot in the hollow beam has at least one enlarged part which corresponds substantially to the shape of the head of the suspension member so as to permit engagement of this head through this opening.

7. Device as claimed in claim 6 which comprises in combination with the transverse slots in the beam, slot segments at right angles to said transverse slots corresponding substantially to the width of the transverse arm of the T of the suspension member.

8. Device as claimed in claim 7 in which these slot segments extend from at least one side of the transverse slots in the beam.

* * * * *